US007026997B2

(12) United States Patent
Rahola

(10) Patent No.: US 7,026,997 B2
(45) Date of Patent: Apr. 11, 2006

(54) MODIFIED SPACE-FILLING HANDSET ANTENNA FOR RADIO COMMUNICATION

(75) Inventor: Jussi Rahola, Espoo (FI)

(73) Assignee: Nokia Corporation, Espoo (FI)

( * ) Notice: Subject to any disclaimer, the term of this patent is extended or adjusted under 35 U.S.C. 154(b) by 10 days.

(21) Appl. No.: 10/830,855

(22) Filed: Apr. 23, 2004

(65) Prior Publication Data

US 2005/0237238 A1 Oct. 27, 2005

(51) Int. Cl.
*H01Q 1/38* (2006.01)

(52) U.S. Cl. ..... 343/700 MS

(58) Field of Classification Search ..... 343/700 MS, 343/702, 793, 795, 846, 895
See application file for complete search history.

(56) References Cited

U.S. PATENT DOCUMENTS

| | | | | |
|---|---|---|---|---|
| 6,525,691 | B1 * | 2/2003 | Varadan et al. | 343/700 MS |
| 2004/0119644 | A1 * | 6/2004 | Puente-Baliarda et al. | 343/700 MS |
| 2004/0217916 | A1 * | 11/2004 | Illera et al. | 343/895 |
| 2005/0110682 | A1 * | 5/2005 | Tran | 343/700 MS |

OTHER PUBLICATIONS

"Active zone self-similarity of fractal-Sierpinski antenna verified using infra-red thermograms" by J.M. Gonzalez et al. Electronics Letters, Aug. 19, 1999, vol. 35, No. 17 pp. 1393-1394.

"Self-similar Surface Current Distribution on Fractal Sierpinski Antenna Verified with Infra-red Thermograms". by M. Navarro et al, IEEE Antennas and Propagation Society International, Symposium, 1999, IEEE, vol. 3, pp. 1566-1569.

"Fractal Design of Multiband and Low Side-Lobe Arrays" by C. Puente-Baliarda et al, IEEE Trans. Antennas Propagat., vol. 44, No. 5, 1996, pp. 730-739.

"Fractal multiband antenna based on the Sierpinski gasket" by C. Puente et al, Electronics Letters, vol. 32, No. 1, Jan. 4, 1996, pp. 1-2.

"Multiband properties of a fractal tree antenna generated by electrochemical deposition" by C. Puente, et al. Electronics Letters, Dec. 5, 1996, vol. 32, No. 25, pp. 2298-2299.

(Continued)

*Primary Examiner*—Hoang V. Nguyen

(57) ABSTRACT

For manufacturing an antenna there is first defined a meandering shape. A simulated current distribution is determined for a conductive line having said meandering shape. First and second segments of said meandering shape are identified, at which said simulated current distribution exhibits first and second currents respectively, so that a vector sum of said first and second currents is essentially zero. A bend containing said first and second segments is replaced with a direct connection in said meandering shape, thus producing a pruned meandering shape. The antenna will have a radiating antenna element that has a shape equal to said pruned meandering shape.

19 Claims, 6 Drawing Sheets

OTHER PUBLICATIONS

"On the Behavior of the Sierpinski Multiband Fractal Antenna" by C. Puente-Baliarda et al, IEEE Transactions on Antennas and Propagation, Vol. 46 No. 4, Apr. 1998, pp. 517-524.

"Small but long Koch fractal monopole" by C. Puente et al Electronics Letters, Jan. 8, 1998, vol. 34, No. 1, pp. 9-10.

"Variations on the Fractal Sierpinski Antenna Flare Angle" by C. Puente et al, IEEE Antennas and Propagation Society. International Symposium, 1998, vol. 4, 1998, pp. 2340-2343.

"Fractal-Shaped Antennas and Their Application to GSM 900/1800" by C. Puente et al, Proceedings of the AP 2000 Millennium.

Conference on Antennas & Propagation, Davos, Switzerland, Apr. 9-14, 2000, ESA Publications Division, Noordwijk, the Netherlands 2000.

"Fractal Antenna Engineering: The Theory and Design of Fractal Antenna Arrays" by D. Werner et al, IEEE Antennas. and Propagation Magazine, vol. 41, No. 5, Oct. 1999 pp. 37-59.

* cited by examiner

MODIFIED SPACE-FILLING HANDSET ANTENNA FOR RADIO COMMUNICATION

TECHNICAL FIELD

The invention belongs basically to the field of small-sized radio antennas. Especially the invention is related to utilizing a space-filling curve in the design of an antenna for a portable communications device.

BACKGROUND OF THE INVENTION

The portable communications devices of modern telecommunications systems need antennas that should fulfil a number of requirements, some of which appear to be mutually contradictory. The antenna should be small, light and easy to manufacture in large-scale mass production at low cost. The antenna should have resonant frequencies in multiple frequency ranges, which in cellular communications systems are up to 1000 MHz apart from each other, and in FM radio reception can be as low as below 100 MHz. The input impedance of the antenna should match the impedance of an antenna port of a transceiver or receiver over a relatively wide frequency band. Losses in the antenna, caused by conduction losses in the conductive parts of the antenna and dielectric losses in the supporting and surrounding materials, should be as low as possible.

Especially the requirement for a small size causes difficulties. In general, the smaller the antenna is made, the narrower its impedance bandwidth becomes. The miniaturization requirements concern not only the radiating antenna part; also the ground plane related to the antenna structure should be as small as possible.

Interesting developments in this field have been introduced in the form of fractal antennas. A fractal is a self-similar structure, which means that a small part of the structure is a scaled-down copy of the original structure. A fractal antenna is one where a radiating antenna element has the shape of a fractal curve. The self-similarity of the structure often leads to multifrequency operation, because at a higher frequency and thus a smaller wavelength a smaller part of the antenna replicates the resonant characteristics of the whole antenna at a lower frequency. A fractal curve is also relatively long compared to the overall two-dimensional area it occupies. This is advantageous, because the end-to-end length of a line-shaped antenna radiator must be at least one quarter of the wavelength at the desired resonant frequency. It is relatively easy to make a small-sized antenna structure by using a tightly meandering fractal curve as the radiating part.

Known prior art patents and patent applications involving fractal antenna design include U.S. 20020190904 A1; U.S. Pat. No. 6,476,766; U.S. Pat. No. 6,452,553; U.S. Pat. No. 6,445,352; U.S. Pat. No. 6,140,975; U.S. Pat. No. 6,127,977; U.S. Pat. No. 6,104,349; WO 2004/001894; WO 03/023900; WO 01/54225; WO 01/54221; WO 99/57784; WO 97/06578; EP 1 313 166; EP 1 258 054; EP 1 227 545; EP 1 223 637 and ES 2 112 163. A list of known scientific publications is provided below at the end of the detailed description. Some of these publicly available documents also introduce the concept of space-filling curves. A space-filling curve is not a fractal, because it does not replicate itself in smaller scale. However, much like many fractals, space filling curves are defined by recursive replacement rules. There is a certain degree of similarity between the recursive iterations when a space-filling curve is developed. By proceeding through a large number of iterative replacement rounds it is mathematically possible to make a space-filling curve fill in a given space up to any given arbitrary percentage. A mathematically more accurate description of a genuine space-filling curve is a function that continuously maps the unit interval onto a bounded region of higher dimension.

The problems of known fractal and space-filling antennas are usually related to modest efficiency and too narrow bandwidth. Efficiency problems can be tracked to the requirement of making the meandering conductive trace in the antenna relatively long, in order to achieve an impedance match to the antenna port of a transceiver or receiver at required operating frequencies.

BRIEF SUMMARY OF THE INVENTION

An objective of the present invention is to present an antenna that is small in size but still efficient enough for use in a portable communications devices. An additional objective of the invention is to ensure that such an antenna has a wide enough bandwidth. Another objective of the invention is to present an organized method for designing antennas of the kind meant above so that they match certain predefined criteria related to bandwidth, input impedance and efficiency.

The objectives of the invention are achieved by designing a radiating antenna element to resemble a space-filling curve of which certain non-contributing sections are eliminated.

According to an aspect of the invention there is provided an antenna for communication through radio frequency signals, comprising a radiating antenna element which is a meandering conductive line, wherein the meandering conductive line has the form of a pruned space-filling curve, in which a straight line segment exists at a location where a genuine space-filling curve would contain a bend.

According to another aspect of the invention there is provided a portable communications device for communication through radio frequency signals, comprising:

an antenna and a receiver capable of receiving radio signals through said antenna; wherein the antenna comprises a radiating antenna element which is a meandering conductive line in the form of a pruned space-filling curve, in which a straight line segment exists at a location where a genuine space-filling curve would contain a bend.

According to another aspect of the invention there is provided a method for manufacturing an antenna for communication through radio frequency signals, comprising the steps of:

defining a meandering shape, determining a simulated current distribution for a conductive line having said meandering shape, identifying first and second segments of said meandering shape at which said simulated current distribution exhibits first and second currents respectively, a vector sum of said first and second currents being closer than a predetermined limit to zero, replacing a bend containing said first and second segments with a direct connection in said meandering shape, thus producing a pruned meandering shape, and manufacturing an antenna in which a radiating antenna element has a shape equal to said pruned meandering shape.

According to another aspect of the invention there is provided a method for manufacturing an antenna for communication through radio frequency signals, comprising the steps of:

defining a meandering shape, determining a simulated current distribution for a conductive line having said meandering shape, identifying a group of segments of said meandering shape at which said simulated current distribution exhibits a group of currents respectively, a vector sum of said group of currents being closer than a predetermined limit to zero, replacing a meandering section containing said group of segments with a straighter connection in said meandering shape, thus producing a pruned meandering shape, and manufacturing an antenna in which a radiating antenna element has a shape equal to said pruned meandering shape.

The invention is based on the insight according to which basic meandering and space-filling curves include certain sections that together produce an essentially zero net effect on the far field, if the curve is used as an antenna. Said zero net effect is a consequence of currents of essentially the same absolute magnitude flowing into essentially opposite directions in sections that are relatively close to each other. On the other hand, currents flowing through said sections give rise to reactive near fields, which in turn cause dielectric losses in the nearby dielectric materials. Also losses in the conductive material of the antenna itself may amount to not insignificant values, especially if the end-to-end length of the antenna is large. All in all, said sections can be considered as unnecessary, or even harmful from the viewpoint of the overall performance of the antenna.

The invention involves also a surprising observation according to which eliminating said unnecessary or harmful sections does not change the resonance frequency characteristics of the antenna even nearly as much as could be expected by simply looking at the decreasing end-to-end length of the antenna. Eliminating said unnecessary or harmful sections means deleting them from the basic or genuine meandering or space-filling curve and connecting the free ends of the remaining parts of the curve to each other in the most straightforward way. Since the new connection between said free ends is inevitably shorter than the original connection that included said unnecessary or harmful sections, the elimination makes the antenna shorter in end-to-end length. However, we have observed that as a result of eliminating the unnecessary or harmful sections, the resonance frequency of the antenna will only increase by a fraction of the percentage by which the end-to-end length decreased.

According to the invention, an antenna element is designed and manufactured to resemble a pruned meandering or space-filling curve. Conceptually the manufacturing process can be regarded to comprise generating a basic or genuine meandering or space-filling curve and performing an optimization calculation, in which sections of the basic or genuine meandering or space-filling curve are consecutively eliminated until a simulation calculation shows that a set of predefined operational criteria are met. A conductive antenna element is manufactured to match the meandering or space-filling curve after eliminating said sections.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated.

Figure 1:
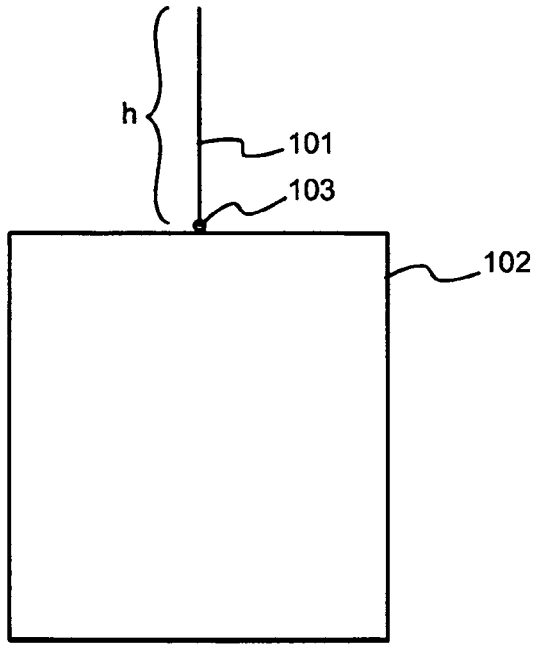
Fig. 1 PRIOR ART
FIG. 1 illustrates schematically a known straight wire monopole antenna.

In order to enable fully understanding the invention, certain known facts of monopole antennas and space-filling curves are first discussed. FIG. 1 illustrates a very basic known monopole antenna, which comprises an essentially linear radiating antenna element 101, an associated ground plane 102 and a feed point 103. The physical end-to-end length of the radiating antenna element 101 is designated as h.

The lowest operating frequency $f_1$ of the straight wire monopole antenna corresponds to a wavelength $\lambda_1$, for which $h=\lambda_1/4$. When an oscillating signal of frequency $f_1$ is applied to the antenna, the distribution of electric current along the length of the radiating antenna element 101, the length considered in the direction from the feed point 103 towards the open end of the radiating antenna element 101, is proportional to one quarter of a cosine wave with a maximum value at the feed point 103 and a zero at the open end. The two next highest operating frequencies $f_2$ and $f_3$ are odd integral multiples of $f_1$ ($f_2=3f_1$ and $f_3=5f_1$) and correspond to wavelengths $\lambda_2$ and $\lambda_3$, for which $h=3\lambda_2/4$ and $h=5\lambda_3/4$ respectively. At frequency $f_2$ the current distribution along the length of the radiating antenna element 101 is proportional to three quarters of a cosine wave, and at frequency $f_3$ to five quarters of a cosine wave respectively. At these operating frequencies a maximum of the current distribution is always located at the feed point 103, and a zero at the open end of the radiating antenna element 101.

Figure 2A:
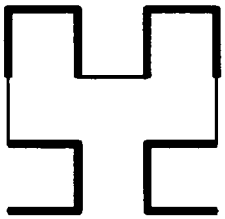
Fig. 2a PRIOR ART
FIGS. 2*a* to 2*c* illustrate the known generation of a space-filling curve through recursion.
Figure 2B:
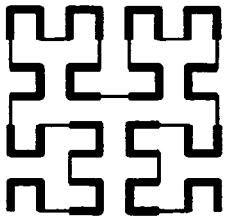
Fig. 2b PRIOR ART
Figure 2C:
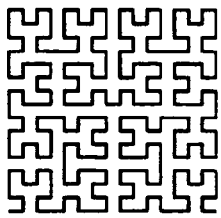
Fig. 2c PRIOR ART

FIGS. 2*a*, 2*b* and 2*c* illustrate the principle of constructing a genuine or basic space-filling curve through iteration. The Hilbert curve is shown as an example. FIG. 2*a* is a basic, meandering line form, from which the next iteration step of FIG. 2*b* is obtained by replacing the four three-sided, rectangular segments shown in thicker line with scaled-down copies of the basic line form itself. Similarly the iteration step from the line form of FIG. 2*b* to that of FIG. 2*c* involves replacing the 16 segments shown in thicker line with appropriately scaled-down copies of the basic line form of FIG. 2*a*. Repeated iterations would produce more and more complicated line forms that eventually fill in the square space defined by the outline of the original curve of FIG. 2*a*.

In the following we will use the designation "space-filling antenna" to describe an antenna structure that otherwise resembles that shown in FIG. 1 but has a radiating antenna element in the form of a space-filling curve instead of a straight line like in FIG. 1. The space-filling curve may have two ends, of which one end is connected to the feed point while the other end is the open end of the radiating antenna element. In that case the antenna structure is a space-filling monopole antenna. In other cases the space-filling curve constitutes a loop, one point of which is connected to the feed point. If the distant end of the space-filling curve comes near to the feed point and is short-circuited to the ground plane, a space-filling loop antenna is formed. It is also possible to use a loop-formed space-filling curve as a radiating antenna element without grounding any point of it, or with some suitably selected point other than the distant end short-circuited to the ground plane (using carefully selected grounding points along a radiating antenna element is basically known e.g. from planar inverted-F antennas). Other known and commonly used techniques for deliberately loading an antenna include but are not limited to bringing an open end of a radiating antenna element close to the ground plane for capacitive coupling, and/or enlarging an open end of the radiating antenna element.

Figure 3A:
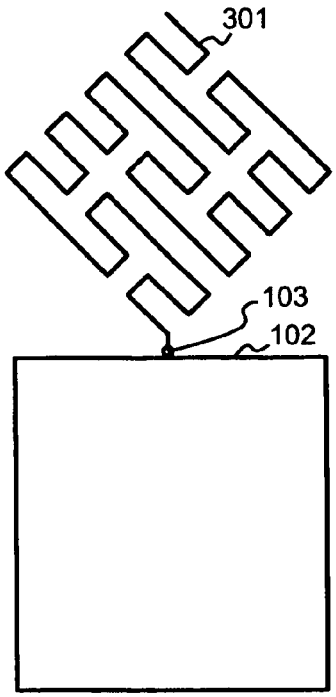
Fig. 3a PRIOR ART
FIGS. 3*a* to 3*e* illustrate schematically some known space-filling antennas.
Figure 3B:
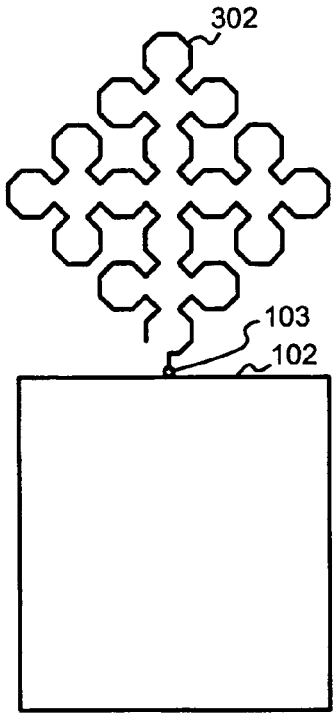
Fig. 3b PRIOR ART
Figure 3C:
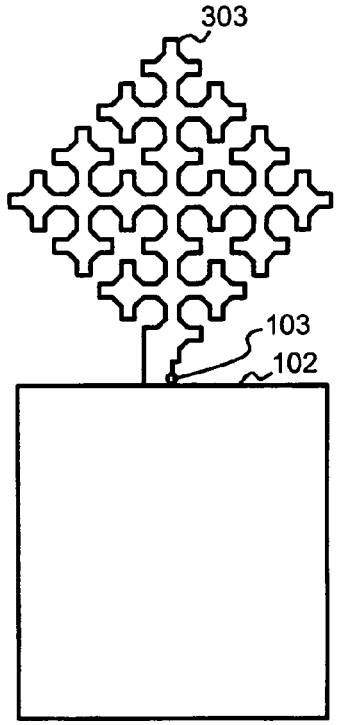
Fig. 3c PRIOR ART
Figure 3D:
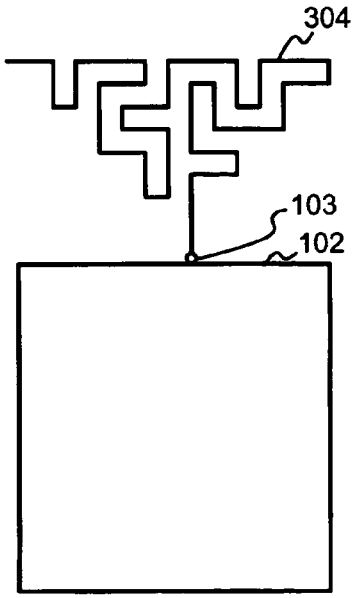
Fig. 3d PRIOR ART
Figure 3E:
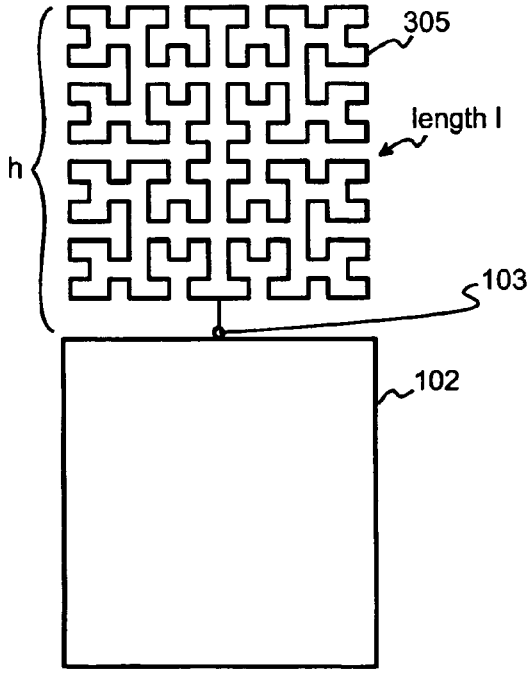
Fig. 3e PRIOR ART

FIGS. 3*a* to 3*e* illustrate schematically various space-filling antennas. All of them have a ground plane 102 and a feed point 103. As a radiating antenna element, the antenna of FIG. 3*a* has a conductive element 301 shaped like a Peano curve. The radiating antenna element 302 of FIG. 3*b* is shaped like a Sierpinski curve of a certain recursion level with an open distant end obtained by cutting the basic form of the space-filling curve near the feed point. The radiating antenna element 303 of FIG. 3*c* is shaped like a Sierpinski curve of a certain higher recursion level with a grounded distant end. The antenna of FIG. 3*d* has a radiating antenna element 304 shaped like a Knuth curve. The antenna of FIG. 3*e* has a radiating antenna element 305 obtained by making four copies of a Hilbert curve form a loop, without grounding any point of it. Depending on the exact form of each curve there may be a short connecting segment at the feed point that is not part of the exact mathematical form of the curve. We will assume that a potential connecting segment does not affect significantly the operational characteristics of the antenna.

FIGS. 3*a* to 3*e* should be understood schematically, so that they do not e.g. limit the mutual physical locations of the radiating antenna element and the ground plane. Later in this description we will consider physical locations of the various elements of the antenna structure, as well as potential couplings between the radiating antenna element and the ground plane, in more detail.

For the purpose of comparing with e.g. the linear monopole antenna we define the length l of the radiating antenna element in a space-filling antenna to be the physical length, measured along the curve, between the feed point and the point of the curve most distant from the feed point. It should be noted that for loop-shaped, ungrounded radiating antenna elements this means that the length is one half of the whole length of the curve. Due to the tightly meandering nature of the space-filling curve, said length is in all cases much greater than the height h of the radiating antenna element, or more generally the overall outer dimensions of the radiating antenna element.

For given ground plane dimensions and a given antenna height h it is easy to make a space-filling antenna have a much lower operating frequency than a straight wire monopole, simply because the length l of the radiating antenna element in the space-filling antenna is much longer than h. Conversely, for a given operating frequency, a space-filling antenna can be easily made to have a lower antenna height h than a straight wire monopole. Increasing the degree of recursion in the space-filling antenna further increases the length of the radiating antenna element (which in any case is typically much larger than $\lambda/4$) and correspondingly lowers the operating frequency. However, increasing the degree of recursion also tends to increase the level of losses.

A known characteristic of space-filling multiband antennas is that the operating frequencies are closer together in relative sense than those of a straight wire monopole. For example, a space-filling antenna having a radiating antenna element shaped like a Hilbert curve, the ratio of the second operating frequency to the first one is 2 or less depending on the degree of recursion, whereas for a straight wire monopole it is 3. During the development work leading to the present invention an exemplary set of space-filling antennas was measured. Said antennas all had identical ground planes and the same antenna height h. Each had a radiating antenna element shaped like a Hilbert curve, so that for the first antenna the degree of recursion was one, for the second antenna the degree of recursion was two, for the third antenna the degree of recursion was three and for the fourth antenna the degree of recursion was four. In a measurement between 200 MHz and 2 GHz the first antenna had one operating frequency band centered at approximately 1450 MHz and the second antenna had one operating frequency band centered at approximately 1200 MHz. The third antenna had two operating frequency bands at approximately 900 MHz and 1650 MHz, and the fourth antenna had a total of four operating frequency bands at 780 MHz, 1240 MHz, 1490 MHz and 1910 MHz.

Figure 4A:
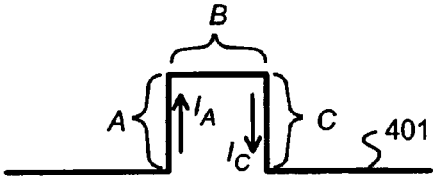
FIGS. 4*a* and 4*d* illustrate the concept of eliminating segments or pruning.

FIG. 4*a* illustrates a piece of conductive line 401, which comprises segments A, B and C. Of these, segments A and C are parallel to each other and equal in length. If an electric current flows through the conductive line 401, with no component currents branching off or being added between said segments, the current $I_A$ flowing through segment A is opposite in direction but essentially equal in magnitude with the current $I_C$ flowing through segment C. Observed at a distance that is large compared to the distance between segments A and C and their length, the electromagnetic field effects caused by the currents $I_A$ and $I_C$ essentially cancel each other. Therefore, again observed at said relatively large distance, it would be difficult to tell the electromagnetic field effects caused by currents flowing in the conductive line 401 from those caused by currents flowing in the conductive wire 411 of FIG. 4*b* The difference between the conductive lines 401 and 411 is that the latter is a "pruned" version of the former, where pruning is taken to mean eliminating segments that together cause a zero net effect when observed at a large distance—meaning segments A and C in FIG. 4*a*. Segment B remains as B' in the conductive line 411, only located between what used to be the starting points of segments A and C.

Assuming that the conductive lines 401 and 411 were made of the same material of identical thickness, located in identical surroundings, and also in all other ways similar to each other except for the elimination of segments A and C in the case of conductive line 411, it is easy to understand that an electric current of some identical value passing through each of them in turn will cause higher resistive and dielectric losses in the case of conductive line 401 than in the case of conductive line 411. The reason is the longer end-to-end length of the conductive line 401, which results in higher end-to-end resistance and larger electromagnetic interaction with the surrounding dielectric materials.

Figure 4B:
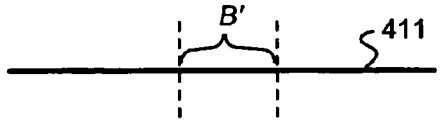
Figure 4C:
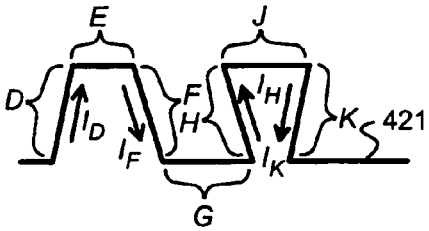
Figure 4D:
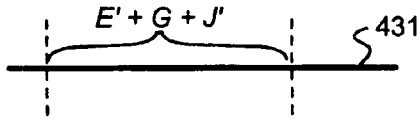

FIGS. 4*c* and 4*d* illustrate a slightly more complicated case, in which a meandering section of the conductive line 421 of FIG. 4*c* originally contains seven segments D, E, F, G, H, J and K to be considered in the elimination process. The currents $I_D$ and $I_K$, as well as currents $I_F$ and $I_H$, constitute mutually cancelling pairs. The pruning operation that results in the straight conductive line 431 of FIG. 4*d* could be thought of as comprising two steps, so that as a first step the most easily recognized pair of segments F and H is eliminated, and after that the next pair of segments D and K is eliminated. However, we may also consider the segments D, F, H and K as a group of segments and notice that taken together, the vector sum of all currents $I_D$, $I_K$, $I_F$ and $I_H$ equals zero. According to the latter viewpoint, the elimination or pruning is a single-stage operation where a whole meandering section of the conductive line is straightened to only include copies E', G and J' of those segments the currents of which were not part of the vector summation that equalled zero.

The groupwise consideration of segments can be further generalized so that in pruning, a bend of arbitrary form in a meandering line of a genuine space-filling curve can be replaced with a straighter connection, if the result of a vector integral of the current distribution over said bend is closer than a predetermined limit to the result of a vector integral of the current distribution over said straighter connection.

For the purpose of evaluating the effects of pruning to the usability of the resulting curves as radiating antenna elements, we may briefly consider the mathematical modelling of an antenna, more exactly the method of moments (MoM) solutions to the boundary integral equations for antennas. In the method of moments, a radiating antenna element is considered to consist of a sequence of simple line segments. The current flowing through each segment is designated separately as an unknown variable, and these unknown variables are collected into a vector I. A system of linear equations is formed as $$ZI=U \tag{1}$$

where Z is the impedance matrix, and the voltage vector U contains the imposed input voltages. A common approximation regarding the voltage vector is that the incident voltage is localized to that segment of the radiating element that is closest to the feed point, which simplifies U so that it only contains one non-zero element. There are as many unknowns in the system of equations (1) as there are segments, or calculational elements, in the model of the radiating antenna element.

The diagonal elements of Z are called the self-impedances and they correspond to the impedances of the individual elements in free space. The non-diagonal elements of Z are called mutual impedances and they describe the interaction of the various calculational elements with each other. The exact values of the mutual impedances depend on the distances, sizes and relative orientations of the elements.

Let us suppose that the antenna is fed at the element number 1. We may compute the input impedance $Z_{in}$ of the antenna by setting the first element of the voltage vector U equal to some known input voltage $U_1$ and all other elements of the voltage vector U equal to zero. Solving the system of linear equations gives the current distribution I of the antenna. We may write $Z_{in}=U_1/I_1$ and, taken the formula for $U_1$ from equation (1), expand as $$Z_{in} = Z_{11} + \frac{Z_{12}I_2}{I_1} + \frac{Z_{13}I_3}{I_1} + \frac{Z_{14}I_4}{I_1} + \ldots + \frac{Z_{1N}I_N}{I_1} \tag{2}$$

where we have assumed that there are N segments in the model of the radiating antenna element. It is easy to interpret equation (2) so that in general the n:th term of the summation on the right-hand side gives the contribution of the n:th segment of the radiating antenna element to the overall input impedance, where n gets values from 1 to N.

If the conductive line 401 of FIG. 4*a* was a piece of a radiating antenna element, we may assume that each of the segments A, B and C appeared in the mathematical model thereof as an individual segment or calculational element. Thus the part of the input impedance's summation formula that reflected their contribution would be of the form $$\ldots + \frac{Z_{1A}I_A}{I_1} + \frac{Z_{1B}I_B}{I_1} + \frac{Z_{1C}I_C}{I_1} + \ldots$$

We may make the following assumptions and deductions:

1) Segments A and C are very close to each other in the sequential order of segments, which means that the currents $I_A$ and $I_C$ are of essentially the same absolute magnitude.

2) Segments A and C have the same length and direction, and are located far away from the feed point, which means that the mutual impedance terms $Z_{1A}$ and $Z_{1C}$ are of essentially the same magnitude.

3) As a consequence of assumptions 1) and 2) above, as well as of the fact that the currents $I_A$ and $I_C$ flow into exactly opposite directions, the terms related to segments A and C cancel each other from the summation.

4) Segment B is also far away from the feed point, which means that the mutual impedance term $Z_{1B}$ related thereto changes only little even if segment B is moved to the position shown as B' in FIG. 4*b*.

As a general conclusion of the above analysis of FIGS. 4*a* and 4*b* we may state that changing a line form like that of FIG. 4*a* in a radiating antenna element to look like that of FIG. 4*b* instead will have negligible effect on the antenna's far-field behaviour and input impedance. This conclusion is subject to certain restrictions. If segment A was much closer to or much farther away from the feed point of the antenna than segment C, the corresponding mutual impedance terms $Z_{1A}$ and $Z_{1C}$ would not be of the same magnitude anymore, and removing segments A and C would change the input impedance of the antenna. Secondly, if part B was very close to some other part of the antenna, which closeness relation was changed remarkably by replacing segment B with segment B', the change may affect the total distribution of currents and consequently again the input impedance, because all currents through all parts of the antenna are interrelated through equation (1).

On the other hand, the principle of eliminating segments of a radiating antenna element can be generalized to cover more than two segments simultaneously. We may assume that a group of segments can be identified, for which the following assumptions hold to a reasonable accuracy:

1') The sum of the moments, i.e. currents times lengths in vector representation, calculated over all segments in the group is zero, meaning that their net effect to the far field is zero.

2') The sum of terms of the form $Z_{1n}I_n/I_l$ over all segments n of the group is zero, meaning that their net contribution to the input impedance is zero.

3') Removing the segments of the group and correspondingly moving the remaining segments m causes only small changes to the mutual impedance terms $Z_{1m}$ corresponding to the remaining segments.

As a consequence the segments of the identified group can be removed without essentially changing the antenna's far-field behaviour or input impedance. In practical cases, the "reasonable accuracy" clause means that something "being zero" means that said something is close to zero than some predetermined, small limiting value.

Figure 5A:
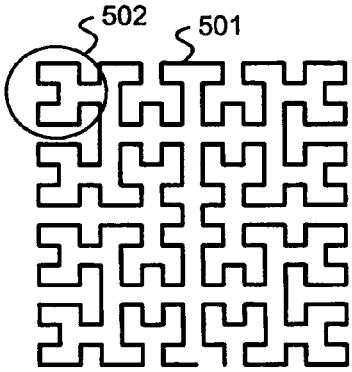
FIGS. 5*a* and 5*b* illustrate pruning a certain space-filling curve.

FIGS. 5*a* to 6*c* illustrate applying the pruning concept to two variations of the Hilbert curve, each time observing the conditions 1) to 4) or 1') to 3') above. The curve 501 of FIG. 5*a* is a combination of four copies of a Hilbert curve and constitutes essentially a loop including a total of 16 fork- or Y-shaped curve sections that are characteristic to Hilbert curves. One small connection of the genuine Hilbert space-filling curve is missing at the middle of the lowest part of the loop, simply in order to make the curve 501 form an end-to-end line, which is usually more advantageous a form considering antenna applications than a complete loop. One of said fork- or Y-shaped curve sections is shown encircled as 502. FIG. 5*b* shows a pruned, essentially loop-shaped curve 511, where each of said 16 fork- or Y-shaped curve sections has been simplified by eliminating the bay between the teeth of the fork, or between the upper branches of the Y, and replacing it with a straight line. Each of said 16 curve sections now resembles more the business end of a hammer or a club, see exemplary section 512.

Figure 5B:
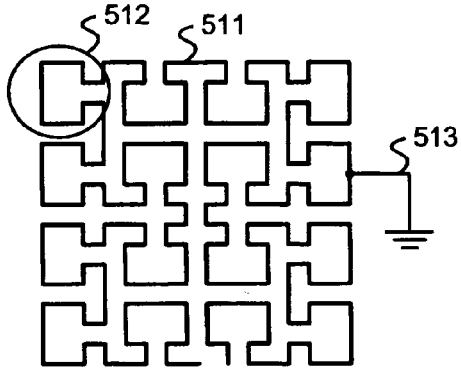

FIG. 5*b* illustrates also schematically the possibility of making a grounding connection 513 at some carefully selected point along a radiating antenna element shaped like a pruned space-filling curve. Such grounding connections are used for tuning, and their coupling to the radiating antenna element and/or to the ground plane may be capacitive or galvanic. Also controllable switches may be used in grounding connection(s), so that selecting the state(s) of the switch(es) will dynamically affect the resonance characteristics of the antenna.

Figure 6A:
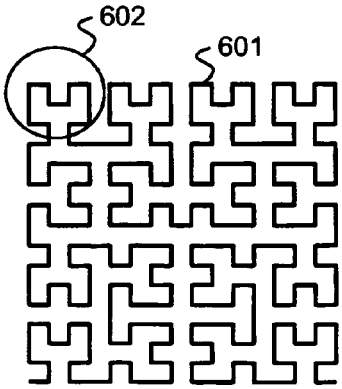
FIGS. 6*a* to 6*c* illustrate pruning another space-filling curve.
Figure 6B:
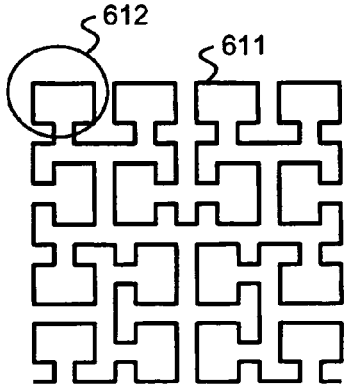
Figure 6C:
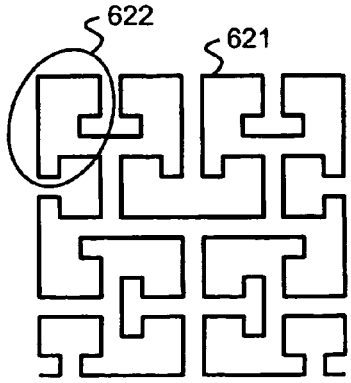

The Hilbert curve 601 of FIG. 6*a* does not constitute a loop. Still, it also includes 16 fork- or Y-shaped curve sections, one of which is shown encircled as 602. FIG. 6*b* shows a pruned Hilbert curve 611, in which each of the 16 fork- or Y-shaped curve sections has been simplified in the same manner as was explained above in association with FIG. 5*b*. An example of a curve section that after pruning resembles the business end of a hammer or club is shown as 612. FIG. 6*c* illustrates a curve 621 that has been obtained by pruning the curve 611 of FIG. 6*b* even further. To be exact, the curve of FIG. 6*c* has been obtained from that of 6*b* by considering those curve sections that after the first pruning step resembled the business end of a hammer or club, picking those 12 of them having a side where a square U-shaped bend appeared in the middle of an otherwise straight line segment, and straightening said square U-shaped bend. An exemplary result of further pruning a curve section this way is shown as 622.

Pruning, which can also be designated as removing segments that have been found to fulfil the conditions 1) to 4) or 1') to 3') above, has several benefits. Firstly, it makes the radiating antenna element simpler and thus easier to manufacture. It also makes the radiating antenna element shorter in length, which makes resistive losses slightly smaller. Additionally it makes dielectric losses smaller, because before pruning the small bends involved caused electromagnetic energy to be stored in the near fields of the bends, which made the antenna more susceptible to dielectric losses in the dielectric materials surrounding the radiating antenna element.

It has been found that even if pruning makes the radiating antenna element shorter in end-to-end length, it does not automatically increase the operating frequencies as much as could be expected. In an experiment made during the research work that led to the invention, pruning a radiating antenna element based on the Hilbert curve shortened the end-to-end length of the radiating antenna element by 35%, but only made the operating frequency 12% higher. In the process of designing an antenna this can be accounted for by first designing a space-filling antenna for which a simulation calculation shows the operating frequency to be somewhat too low, and then pruning until a renewed simulation calculation shows that the desired operating frequency has been reached.

Figure 7:
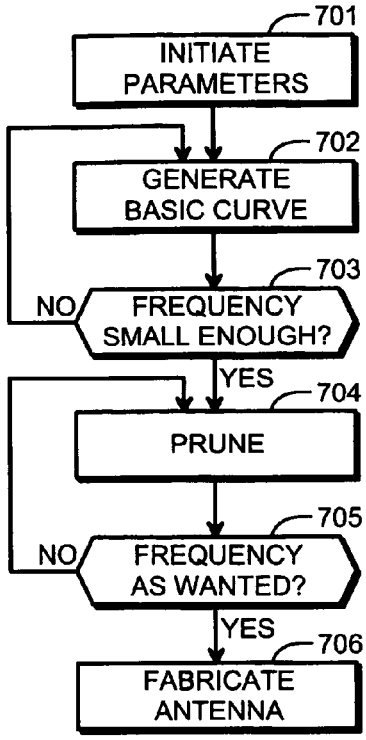
FIG. 7 illustrates a method according to an embodiment of the invention.
Figure 8:
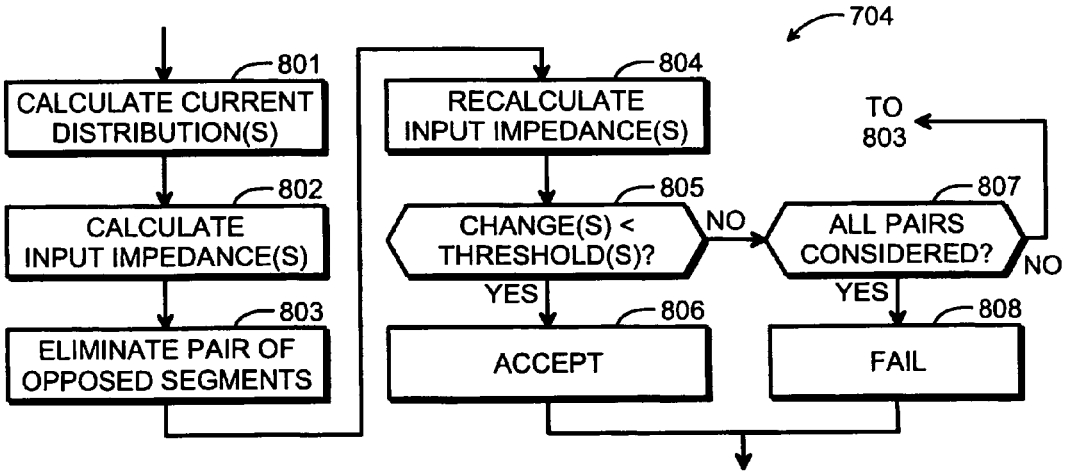
FIG. 8 illustrates some details of the method shown in FIG. 7, FIGS. 9*a* and 9*b* illustrate an antenna according to an embodiment of the invention.

FIGS. 7 and 8 illustrate an exemplary systematic method of designing and manufacturing an antenna according to the invention. Step 701 comprises initiating parameters, i.e. selecting the desired operation frequency or frequencies at which the antenna should be operating, and deciding the various threshold values and acceptability limits that will be applied in the design process. At step 702 a basic curve is generated, preferably by performing a number of recursion steps that generate a genuine space-filling curve such as shown in FIG. 5*a* or FIG. 6*a*. A check is made at step 703, whether the initial operating frequency of an antenna having a radiating antenna element shaped like the generated curve is low enough in order to take into account the inevitable, expected increase in operating frequency that will result from pruning. How much the initial operating frequency must be lower than the eventually desired operating frequency has been decided at step 701. As long as the initial operating frequency is not low enough, the process returns to step 702 for refining the initial curve, for example by performing one more recursion step.

When a low enough initial operating frequency has been obtained, there follows some pruning at step 704. The action taken at step 704 is described in more detail below in association with FIG. 8. A check is made at step 705 to determine, whether pruning has increased the operating frequency enough to arrive at the eventually desired operating frequency. As long as the finding at step 705 is negative, there will occur a return to step 704 for further pruning. A positive finding at step 705 means that designing the antenna has been completed, after which it can be manufactured at step 706 by applying technology known as such. The generation of the basic curve at step 702, the operating frequency calculations at steps 703 and 705, as well as the pruning at step 704 were most preferably all accomplished in a mathematical antenna simulator. How close the calculated operating frequency must be to the eventually desired operating frequency to cause a positive finding at step 705 has been determined as a part of step 701.

FIG. 8 shows an exemplary more detailed way of performing the pruning at step 704. An initial current distribution and an initial input impedance are calculated for the antenna at steps 801 and 802 respectively. At step 803 there are located at least two segments of the radiating antenna element that are close to each other and carry currents the vector sum of which is close to zero. How close the segments must be to each other, as well as how close the vector sum of their currents must be to zero, has been determined as a part of step 701. The segments so found are eliminated by following the principle illustrated earlier in FIGS. 4*a* and 4*b*.

At step 804 the input impedance of the antenna is recalculated with the elimination performed at step 803 taken into account. At step 805 a check is made, whether the change in input impedance that resulted from the elimination at step 803 is smaller than an acceptability threshold defined earlier at step 701. The check made at step 805 may take into account the one-time change in input impedance and/or an accumulated change since the pruning started. A positive finding at step 805 allows accepting the elimination according to step 806. If the finding at step 805 was negative, there follows a check at step 807, whether all possible pairs (or groups) of segments viable for elimination have been tried already. If not, there occurs a transition back to step 803 where another pair (or group) of segments is now selected. A positive finding at step 807 means that no solution can be found to the given design problem with the currently valid boundary conditions. In order to take into account the possibility of exiting step 704 through the failure-indicating substep 808 means that the process described in general in FIG. 7 must also include a way of exiting with a failure indication (not shown in FIG. 7).

The description has concentrated so far on single-band space-filling antennas. In case a dual- or multiband antenna is to be considered, the concept of finding an optimal antenna shape through pruning includes also the possibility of selecting, whether the pruning should affect only one operating frequency band or at least two operating frequency bands simultaneously. It should be noted that both impedance and current distribution depend heavily on frequency. If the relative magnitudes of at least two operating frequencies are to be kept the same, only such pairs or groups of segments should be selected for pruning for which the cancellation of currents and sameness of mutual impedance terms hold for all operating frequencies considered. On the other hand it is possible to change the multiband behaviour of an antenna by deliberately selecting such pairs or groups of segments for pruning for which the currents cancel each other at a first operating frequency but not at a second operating frequency. As a result, the input impedance after pruning stays the same at said first operating frequency but not at said second operating frequency, which effectively means a change in the second operating frequency. Equations (1) and (2) hold as such for each operating frequency in turn.

In the method diagrams of FIGS. 7 and 8 dual- or multiband operation can easily be accounted for by considering all frequencies at all steps where frequencies are mentioned, by defining a wide enough selection of various threshold values and acceptability limits at step 701, and applying such threshold values and acceptability limits at all appropriate frequencies when it comes to making checks and decisions. FIG. 8 even contains literal indications of how more than one operating frequency may be considered, in the form of bracketed plural forms in steps 801, 802, 804 and 805.

Figure 9A:
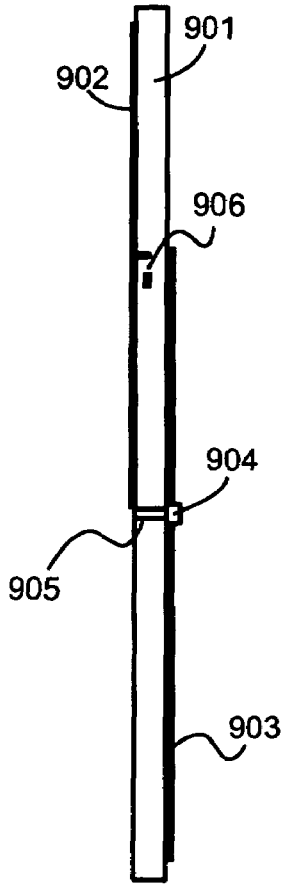
Figure 9B:
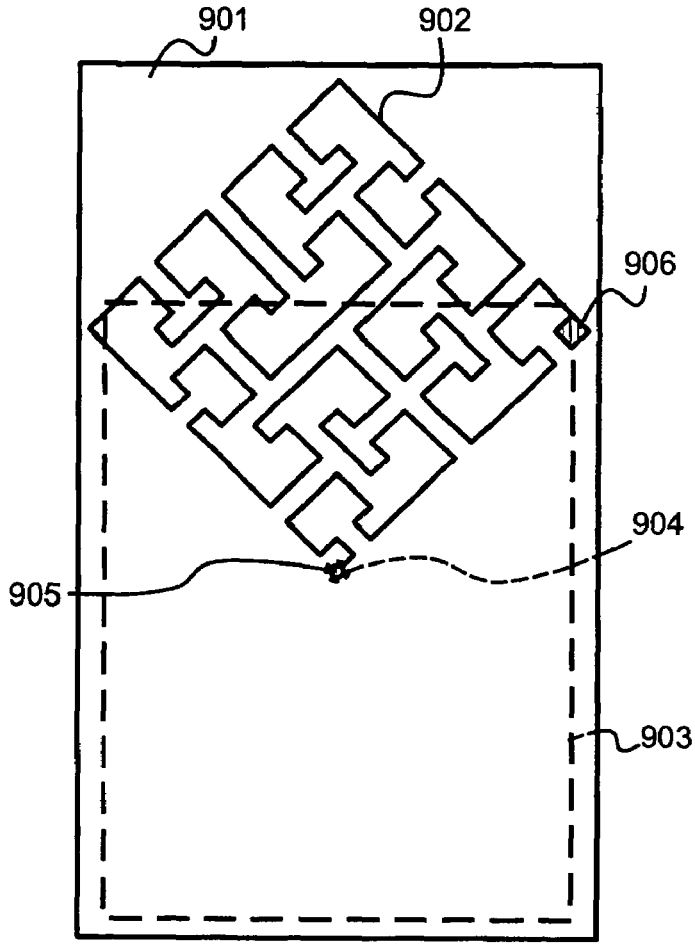

FIGS. 9*a* and 9*b* illustrate an exemplary antenna according to an embodiment of the invention. A basic support structure of the antenna is a dielectric plate 901. One surface of the dielectric plate 901 supports a radiating antenna element 902 in the form of a meandering curve, which has been obtained by pruning a space-filling curve. In this exemplary embodiment the curve 902 resembles closely that introduced previously in FIG. 6*c*. Another side of the dielectric plate 901 supports a ground plane 903. There is a connector 904 for connecting the antenna to the antenna port of a radio device, which connector 904 is connected to the ground plane 903 directly and to the radiating antenna element 902 through a plated-through hole 905.

For the sake of example, FIGS. 9*a* and 9*b* also show how the distant end of the radiating antenna element 902 comprises an enlarged portion 906, which is located in a dent made in the dielectric plate 901 so that it comes closer than the rest of the radiating antenna element 902 to the ground plane 903.

Figure 10:
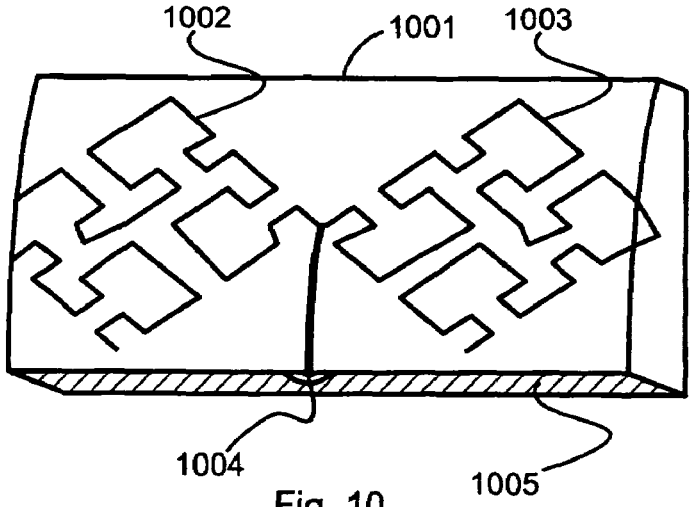
FIG. 10 illustrates an antenna according to another embodiment of the invention and FIGS. 11*a* and 11*b* illustrate portable communications devices according to embodiments of the invention.

The invention places few limitations for varying the structural solutions of the antenna. A non-exclusive list of possible variations is provided in the following. The support structure does not need to be planar or rigid; it can also be curved and/or flexible. Different kinds of support structures could allow at least a part of the ground plane to be placed on a plane that is perpendicular or at some other angle against some plane defined by the radiating antenna element. The radiating antenna element could extend onto two or more planes, or be genuinely three-dimensional. The unbalanced antenna structure could be replaced with a balanced one, making e.g. two space-filling curves constitute a di-pole antenna and using appropriate balanced feed systems. The line width of the radiating antenna element does not need to be constant. The ground plane could be partly or completely one upon the other with the radiating antenna element. FIG. 10 illustrates many of these variations, with a dielectric support structure 1001 having a curved surface that supports a dipole antenna comprising two pruned space-filling curves 1002 and 1003 as well as a balanced feed 1004. Some parts of the space-filling curves 1002 and 1003 extend to other surfaces of the dielectric support structure 1001. A part 1005 of a ground plane is essentially perpendicular against the plane generally defined by the radiating antenna element. The ground plane extends also to the back surface of the dielectric support structure 1001, which is not visible in FIG. 10.

One possible generalization concerns the space-filling nature of the curves that are used as a starting point for designing antennas according to the invention. In the foregoing we have relied completely on space-filling curves. To be quite exact, the concept of optimizing an antenna through pruning as shown in FIGS. 7 and 8 can be applied to arbitrary curves that have some meandering property to start with. However, it is a property of space-filling curves that they use very effectively an available space, and typically also contain a relatively large number of segments that provide good alternatives for pruning. These properties make space-filling curves a preferable selection for curves to start the designing with. Their well-known mathematical properties and relative regularity also help in keeping the antenna characteristics within reasonable limits of expectability, which is advantageous during the design process.

One possible area of applying the invention is the provision of an FM reception antenna to a portable communication device that also has important functionality on significantly higher frequencies. Portable communications devices that have evolved from what used to be just cellular telephones usually communicate with a cellular network on frequencies that are in the range from 800 MHz to 2 GHz. Antennas that work well with those frequencies are not applicable for reception on FM broadcasting frequencies, so a separate antenna should be provided for FM reception, if the same device is to additionally include an FM radio receiver. An antenna according to the invention is a good candidate for such an FM reception antenna, because the invention allows making it small and yet efficient, and because necessary structural factors such as dielectric support plates and ground planes typically already exist in a portable communication device.

Figure 11A:
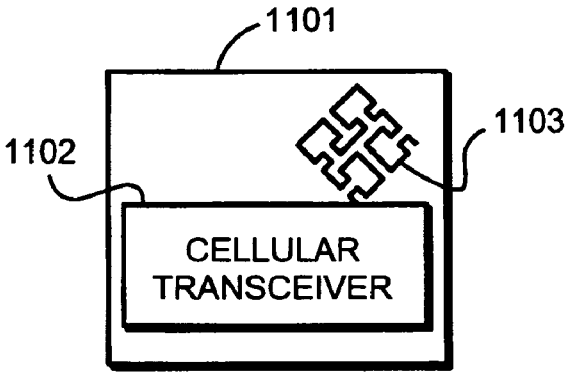
Figure 11B:
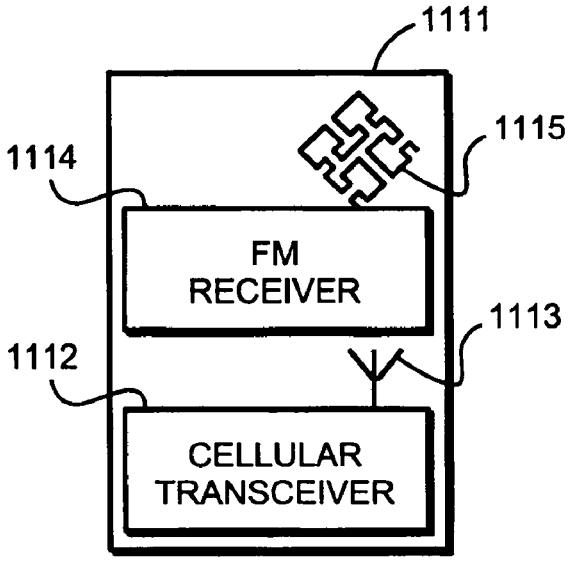

FIG. 11*a* illustrates schematically a portable communications device 1101, which comprises a cellular communications part 1102 for communication with a cellular radio network. The antenna 1103, which is an antenna according to an embodiment of the invention, is connected to said cellular communications part 1102 for at least one of receiving radio signals from said cellular radio network and transmitting radio signals to said cellular radio network. FIG. 11*b* illustrates schematically a portable communications device 1111, which comprises a cellular communications part 1112 for communication with a cellular radio network having an antenna 1113 of its own. The portable communications device also comprises an FM receiver 1114 and an antenna 1115, which is an antenna according to an embodiment of the invention and connected to said FM receiver 1114 for receiving FM broadcasts.

LIST OF PUBLICATIONS

"Iterative network model to predict the behaviour of a Sierpinski fractal network [antennas]", Borja, C.; Puente, C.; Medina, A., Electronics Letters Volume: 34, No.15, 23 Jul. 1998, Page(s): 1443–1445

"Fractal multiband patch antenna", Borja, C.; Puente, C.; Romeu, J.; Anguera, J., Proceedings of the AP 2000 Millennium Conference on Antennas & Propagation, Davos, Switzerland, 9–14 Apr. 2000. ESA Publications Division, Noordwijk, the Netherlands, 2000.

"Printed fractal antennas", Breden, R.; Langley, R. J., IEE National Conference on. Antennas and Propagation, 30 Mar.–1 Apr. 1999, Page(s): 1–4.

"Fractal antennas part 1", Cohen, N., Commun. Quarterly, Summer 1995, pages 7–22.

"Fractal antennas part 2", Cohen, N., Commun. Quarterly, Summer 1996, pages 53–66.

"Fractal and shaped dipoles", Cohen, N., Commun. Quarterly, Spring 1996, pages 25–36.

"NEC2 Modeling of Fractal Element Antennae (FEA)", Cohen, N., Proceedings of the 13th Annual Review of Progress in Applied Computational Electromagnetics (ACES), Naval Postgraduate School, Monterey, Calif., March 1997, Volume I, pages 297–304.

"Fractal loops and the small loop approximation", Cohen, N.; Hohlfeld, R. G., Commun. Quarterly, Winter 1996, pages 77–81.

"Fractal antenna applications in wireless telecommunications", Cohen, N., Electronics Industries Forum of New England, 1997. Professional Program Proceedings, 1997, Page(s): 43–49.

"Active zone self-similarity of fractal-Sierpinski antenna verified using infra-red thermograms", Gonzalez, J. M.; Navarro, M.; Puente, C.; Romeu, J.; Aguasca, A., Electronics Letters Volume: 35, no. 17, 19 Aug. 1999, Page(s): 1393–1394.

"Fast Array Calculations for fractal arrays", Haupt, R.; Werner, D., Proceedings of the 13th Annual Review of Progress in Applied Computational Electromagnetics (ACES), Naval Postgraduate School, Monterey, Calif., March 1997, Volume I, pages 291–296.

"Self-Similarity and the Geometric Requirements for frequency Independence in Antennae", Hohlfeld, R. G., Cohen, N., Fractals Volume 7, No. 1, 1999, Pages 79–84.

"Fractal electrodynamics: From super antennas to superlaftices", Jaggard, D. L., In: Vehel, J. L.; Lufton, E.; Tricot. C, editors, "Fractals in engineering", Springer-Verlag, New York, 1997, pages 204–221.

"Cantor ring arrays", Jaggard, D. L.; Jaggard, A. D., IEEE Antennas and Propagation Society International Symposium, 1998., Volume: 2 1998, Page(s): 866–869

"Characteristics of modified GPS antennas", Kawakami, H.; Sato, G., Ninth International Conference on Antennas and Propagation, 1995 (Conf. Publ. No. 407), 1995, Page(s): 496–499 vol. 1.

"The Fractal Random Array", Kim, Y, Jaggard, D. L., Proceedings of the IEEE, Vol. 74, 1986, Page(s): 1278–1280.

"Time-harmonic and time-dependent radiation by bifractal dipole arrays", Lakhtakia, A.; Varadan, V. K., Varadan, V. V., International Journal of Electronics, Vol. 63, No. 6, 1987, pages 819–824.

"Synthesis of fractal patterns from concentric-ring arrays", Xu Liang; Wu Zhensen; Wang Wenbing, Electronics Letters Volume: 32, No. 21 10 Oct. 1996, Page(s): 1940–1941.

"Multiband characteristics of two fractal antennas", Xu Liang, Chia, M. Y. W, Microwave and optical technology letters Vol 23, No. 4, 1999, Page(s): 242–245.

"Fractals Give Insight into Frequency Independent Antennas", Marsh, J., Antenna systems & technology, July/August 1999, page 15.

"Self-similar surface current distribution on fractal Sierpinski antenna verified with infra-red thermograms", Navarro, M.; Gonzalez, J. M.; Puente, C.; Romen, J.; Aguasca, A., IEEE Antennas and Propagation Society International, Symposium, 1999, IEEE. Volume 3 p. 1566 –1569.

"Fractal Antennas", Ollikainen, J.; Vainikainen, P., NAMS/WP1/T3/SB1 Preliminary investigation report, Helsinki University of Technology, 1.4.1998.

"Fractal Antennas", Puente, C., PhD Dissertation, Dept. of Signal Theory and Communications, Universitat Politecnica de Catalunya, June 1997.

"Multiband fractal antennas and arrays", Puente, C.; Romeu, J.; Pous, R.; Cardama, A., In: Vehel, J. L.; Lutton, E.; Tricot. C, editors, "Fractals in engineering", Springer-Verlag, New York, 1997, pages 222–236.

"Fractal Design of Multiband and Low Side-Lobe Arrays", Puente-Baliarda, C., Pous, R., IEEE Trans. Antennas Propagat., Vol 44, No. 5, 1996, Page(s): 739–739.

"Fractal multiband antenna based on the Sierpinski gasket", Puente, C.; Romeu, J.; Pous, R.; Garcia, X.; Benitez, F., Electronics Letters Volume: 32, No. 1, 4 Jan. 1996, Page(s): 1–2.

"Perturbation of the Sierpinski antenna to allocate operating bands", Puente, C.; Romeu, J.; Bartoleme, R.; Pous, R. Electronics Letters Volume: 32, No. 24, 21 Nov. 1996, Page(s): 2186–2188.

"Multiband properties of a fractal tree antenna generated by electro-chemical deposition", Puente, C.; Claret, J.; Sagues, F.; Romeu, J.; Lopez-Salvans, M. Q.; Pous, R. Electronics Letters Volume: 32, No. 25 , 5 Dec. 1996, Page(s): 2298–2299.

"On the behavior of the Sierpinski multiband fractal antenna", Puente-Baliarda, C.; Romeu, J.; Pous, R.; Cardama, A. IEEE Transactions on Antennas and Propagation, Volume: 46, No. 4, Apr. 1998, Page(s): 517–524.

"Small but long Koch fractal monopole", Puente, C.; Romeu, J.; Pous, R.; Ramis, J.; Hijazo, A. Electronics Letters Volume: 34, No. 1, 8 Jan. 1998, Page(s): 9–10.

"Variations on the fractal Sierpinski antenna flare angle", Puente, C.; Navarro, M.; Romeu, I.; Pous, R. IEEE Antennas and Propagation Society International Symposium, 1998. Volume: 4, 1998, Page(s): 2340 –2343 vol. 4.

"Fractal-shaped antennas", Puente, C.; Romeu, J.; Cardama, A., In: "Frontiers in Electromagnetics", Werner, D. H., Mittra, R., editors., IEEE Press, New York, 2000. Pages 48–93.

"Fractal-shaped antennas and their application to GSM 900/1800", Puente, C.; Anguera, J.; Romeu, J.; Borja, C.; Navarro, M.; Soler, J., Proceedings of the AP 2000 Millennium Conference on Antennas & Propagation, Davos, Switzerland, 9–14 Apr. 2000., ESA Publications Division, Noordwijk, the Netherlands, 2000.

"A fractal based FSS with dual band characteristics", Romeu, J.; Rahmat-Samii, Y., IEEE Antennas and Propagation Society International Symposium, 1999. IEEE Volume: 3, 1999, Page(s): 1734–1737.

"Development of a fractional loop antenna for EMC measurement", Saha, P. K.; Alam Chowdhury, N. M., 1997 International Symposium on Electromagnetic Compatibility, Proceedings, 1997, Page(s): 126 –129.

"Multiband and wideband properties of printed fractal branched antennas", Sindou, M.; Ablart, G.; Sourdois, C., Electronics Letters Volume: 35, No. 3, 4 Feb. 1999, Page(s): 181–182.

"Mod-P Sierpinski fractal Multiband Antenna", Soler, J.; Romeu, J.; Puente, C., Proceedings of the AP 2000 Millennium Conference on Antennas & Propagation, Davos, Switzerland, 9–14 Apr. 2000. ESA Publications Division, Noordwijk, the Netherlands, 2000.

"Fractal stacked monopole with very wide bandwidth", Song, C. T. P.; Hall, P. S.; Ghafouri-Shiraz, H.; Wake, D., Electronics Letters Volume: 35 12, 10 Jun. 1999, Page(s): 945–946.

"Fractal electrical and magnetical radiators", Veliev, E. I.; Onufrienko, V. M., Third International Kharkov Symposium on Physics and Engineering of Millimeter and Submillimeter Waves, 1998. MSMW '98. Volume: 1, 1998, Page(s): 357–359

"Fractal volume antennas", Walker, G. J.; James, J. R., Electronics Letters Volume: 34, No. 16, 6 Aug. 1998, Page(s): 1536–1537.

"On the synthesis of fractal radiation patters,", Werner, D. H.; Werner, P. L.;., Radio Science Volume 30, No. 1, 1995 Pages 29–45.

"Frequency independent features of self-similar fractal antennas", Werner, D. H.; Werner, P. L.; Ferraro, A. J., Antennas and Propagation Society International Symposium, 1996. AP-S. Digest Volume: 3 1996, Page(s): 2050–2053.

"Frequency independent features of self-similar fractal antennas", Werner, D. H.; Werner, P. L., Radio Science Volume 31, No. 6, 1996 Pages 1331–1343.

"Fractal constructions of linear and planar arrays", Werner, D. H.; Haupt, R. L., IEEE Antennas and Propagation Society International Symposium, 1997, 1997 Digest Volume: 3, 1997, Page(s): 1968–1971

"Fractal antenna engineering: the theory and design of fractal antenna arrays", Werner, D. H.; Haupt, R. L.; Werner, P. L., IEEE Antennas and Propagation Magazine Volume: 41, No. 5, Oct. 1999, Page(s): 37–58.

"Radiation characteristics of thin-wire ternary fractal trees", Werner, D. H.; Rubio Bretones, A.; Long, B. R., Electronics Letters Volume: 35, No. 8, 15 Apr. 1999, Page(s): 609–610.

"The theory and design of fractal antenna arrays", Werner, D. H.; Werner, P. L.; Jaggard, D. L.; Jaggard, A. D.; Puente, C.; Haupt, R. L.; In: "Frontiers in Electromagnetics", Werner, D. H., Mittra, R., editors., IEEE Press, New York, 2000. Pages 48–93.

"Fractal antenna elements and arrays", Yang, X.; Chiochetti, J.; Papadopoulos, D.; Susman, L., Applied Microwave & Wireless, vol. 11, no. 5, 1999, p. 34–46.

The invention claimed is:

1. An antenna for communication through radio frequency signals, comprising a radiating antenna element which is a meandering conductive line, wherein the meandering conductive line has the form of a pruned space-filling curve, in which a straight line segment exists at a location where a genuine space-filling curve would contain a bend.

2. An antenna according to claim 1, wherein the meandering conductive line has the form of a pruned Hilbert curve, in which a straight line segment exists at a location where a genuine Hilbert curve would contain a bay between branches of a Y-shaped curve section.

3. An antenna according to claim 1, wherein the meandering conductive line comprises a part having a width that is different than a general width of the meandering conductive line.

4. An antenna according to claim 3, wherein said part is located at an end of said meandering conductive line, said end being distant from a point of said meandering conductive line that constitutes a feed point of said antenna.

5. An antenna according to claim 1, wherein the antenna comprises a ground plane, and wherein said meandering conductive line comprises a part that is located closer than other parts of said meandering conductive line to said ground plane.

6. An antenna according to claim 1, wherein the antenna comprises a ground plane, and wherein the antenna comprises a coupling between said ground plane and a predetermined point of said meandering conductive line.

7. An antenna according to claim 1, additionally comprising a balanced feed and another radiating antenna element which is a meandering conductive line having the form of a pruned space-filling curve, so that said meandering conductive lines together with said balanced feed constitute a dipole antenna.

8. An antenna according to claim 1, comprising:

a dielectric support structure limited by surfaces, of which at least one is a curved surface, a radiating antenna element which is a meandering conductive line having the form of a pruned space-filling curve and extends from said curved surface to another surface of said dielectric support structure, and a ground plane covering at least a part of a ground plane surface of said dielectric support structure, said ground plane surface being directed otherwise than parallelly to surfaces of the dielectric support structure that support said meandering conductive line.

9. A portable communications device for communication through radio frequency signals, comprising:

an antenna and a receiver capable of receiving radio signals through said antenna;

wherein the antenna comprises a radiating antenna element which is a meandering conductive line in the form of a pruned space-filling curve, in which a straight line segment exists at a location where a genuine space-filling curve would contain a bend.

10. A portable communications device according to claim 9, comprising a cellular communications part for communication with a cellular radio network, said antenna being an antenna for at least one of receiving radio signals from said cellular radio network and transmitting radio signals to said cellular radio network.

11. A portable communications device according to claim 9, comprising a cellular communications part for communication with a cellular radio network and an FM radio receiver for receiving FM radio broadcastings, said antenna being a reception antenna of said FM radio receiver.

12. A method for manufacturing an antenna for communication through radio frequency signals, comprising the steps of:

defining a meandering shape, determining a simulated current distribution for a conductive line having said meandering shape, identifying first and second segments of said meandering shape at which said simulated current distribution exhibits first and second currents respectively, a vector sum of said first and second currents being closer than a predetermined limit to zero, replacing a bend containing said first and second segments with a direct connection in said meandering shape, thus producing a pruned meandering shape, and manufacturing an antenna in which a radiating antenna element has a shape equal to said pruned meandering shape.

13. A method according to claim 12, comprising the steps of:

determining a simulated input impedance for a conductive line having said meandering shape, for said identified first and second segments of said meandering shape, determining first and second mutual impedances respectively, each mutual impedance being defined as a mutual impedance in relation to a feeding point at which said simulated input impedance was determined, checking, whether a difference between said first and second mutual impedances is smaller than a predetermined limit and only replacing said bend containing said two segments with a direct connection in said meandering shape if said difference between said first and second mutual impedances was found to be smaller than said predetermined limit.

14. A method according to claim 12, comprising the steps of:

determining a first simulated current distribution corresponding to a first operating frequency for said conductive line having said meandering shape, determining a second simulated current distribution corresponding to a second, different operating frequency for said conductive line having said meandering shape, identifying first and second segments of said meandering shape at which said first simulated current distribution exhibits first and second currents respectively, a vector sum of said first and second currents being closer than a predetermined limit to zero, and at which said second simulated current distribution exhibits third and fourth currents respectively, a vector sum of said third and fourth currents being closer than a predetermined limit to zero, replacing a bend containing said first and second segments with a direct connection in said meandering shape, thus producing a pruned meandering shape, and manufacturing an antenna in which a radiating antenna element has a shape equal to said pruned meandering shape.

15. A method according to claim 12, comprising the steps of:

determining a first simulated current distribution corresponding to a first operating frequency for said conductive line having said meandering shape, determining a second simulated current distribution corresponding to a second, different operating frequency for said conductive line having said meandering shape, identifying first and second segments of said meandering shape at which said first simulated current distribution exhibits first and second currents respectively, a vector sum of said first and second currents being closer than a predetermined limit to zero, and at which said second simulated current distribution exhibits third and fourth currents respectively, a vector sum of said third and fourth currents not being closer than a predetermined limit to zero, replacing a bend containing said first and second segments with a direct connection in said meandering shape, thus producing a pruned meandering shape, and manufacturing an antenna in which a radiating antenna element has a shape equal to said pruned meandering shape.

16. A method according to claim 12, wherein the step of defining a meandering shape involves defining a space-filling curve.

17. A method according to claim 16, wherein the step of defining a meandering shape involves defining a Hilbert curve, and the step of identifying first and second segments of said meandering shape involves identifying a pair of sides of a bay between branches of an Y-shaped section of said Hilbert curve.

18. A method according to claim 12, comprising the steps of:

defining a meandering shape and determining a resonance frequency for a conductive line having said meandering shape, said resonance frequency being lower than a desired operating frequency, after producing a pruned meandering shape, determining a resonance frequency for a conductive line having said pruned meandering shape, and repeating the steps of identifying first and second segments and replacing a bend containing said first and second segments, thus repeatedly producing a further pruned meandering shape, until a resonance frequency determined for a conductive line having a further pruned meandering shape is closer than a predetermined limit to said desired operating frequency.

19. A method for manufacturing an antenna for communication through radio frequency signals, comprising the steps of:

defining a meandering shape, determining a simulated current distribution for a conductive line having said meandering shape, identifying a group of segments of said meandering shape at which said simulated current distribution exhibits a group of currents respectively, a vector sum of said group of currents being closer than a predetermined limit to zero, replacing a meandering section containing said group of segments with a straighter connection in said meandering shape, thus producing a pruned meandering shape, and manufacturing an antenna in which a radiating antenna element has a shape equal to said pruned meandering shape.

* * * * *